United States Patent [19]

Koenig et al.

[11] Patent Number: 4,551,595

[45] Date of Patent: Nov. 5, 1985

[54] TAPE SWITCH WITH CORRUGATED WAVY CONDUCTOR

[75] Inventors: Robert H. Koenig, Huntington Hills, N.Y.; Walter Lovell, Wilbraham, Mass.

[73] Assignee: Tapeswitch Corporation of America, Farmingdale, N.Y.

[21] Appl. No.: 631,494

[22] Filed: Jul. 16, 1984

[51] Int. Cl.[4] ..... H01H 1/06; H01H 13/04

[52] U.S. Cl. ..... 200/86 R; 200/159 B; 200/279

[58] Field of Search ..... 200/61.43, 61.55, 61.57, 200/86 R, 85 R, 275, 279, 159 B, 86 A, 86.5, 85 A

[56] References Cited

U.S. PATENT DOCUMENTS

| | | | |
|---|---|---|---|
| 3,412,224 | 11/1968 | Koenig | 200/86 R |
| 3,544,746 | 12/1970 | Wolf | 200/61.57 X |
| 3,602,677 | 8/1971 | Adelson | 200/275 |
| 3,920,940 | 11/1975 | Brown et al. | 200/86 R X |
| 4,059,737 | 11/1977 | Gergvad | 200/275 |
| 4,446,345 | 5/1984 | Sheiry | 200/86 R X |
| 4,456,798 | 6/1984 | Iwai et al. | 200/86 R |

FOREIGN PATENT DOCUMENTS

| | | | |
|---|---|---|---|
| 845786 | 6/1970 | Canada | 200/86 R |

OTHER PUBLICATIONS

IBM Technical Disclosure Bulletin (USA), vol. 14, No. 3, Aug. (1971), p. 767, "*Elastic Diaphragm Switch*", Sedaris et al.

*Primary Examiner*—G. P. Tolin

*Attorney, Agent, or Firm*—James P. Malone

[57] ABSTRACT

A tape switch has a first insulating cover strip and a second insulating cover strip. A first conductive strip is bonded to the first cover strip and these combined strips have a corrugated wave form at mid-portion where joined. First and second spacer strips run parallel to each other and are mounted between the first and second cover strips. A second conductive strip is bonded to the second cover strip between the first and second spacer strips, whereby when the tape switch is pressed, contact is made between the first and second conductive strips. In a second embodiment the first cover strip has a formed central raised portion to give separation which eliminates need for additional parallel separator stays.

2 Claims, 4 Drawing Figures

TAPE SWITCH WITH CORRUGATED WAVY CONDUCTOR

TECHNICAL FIELD

This invention relates to tape switches and more particularly to a thin flexible laminated contact switch tape, comprising a pair of conductive film strips held separated by thin resilient fiber strips all sandwiched between thin insulating strips. One conductive strip and lamination has a corrugated wave form which provides feel when touched by hand and gives a positive contact action and more importantly, improved coiling characteristics when coiled in a roll.

BACKGROUND ART

This invention is an improvement of U.S. Pat. Nos. 2,896,042, 3,118,984, 3,270,160, 3,412,224, 3,533,404.

THE INVENTION

This invention relates to a thin flexible contact switch tape that can be manufactured utilizing low cost conductive foils and thin resilient strips laminated between protective films in a continuous manner.

This flexible contact switch tape can be used to activate alarm systems, operate low voltage servo controls to turn on and off any electrical device. Because of the low profile in the thickness of this conduct switch tape, it can be placed in positions that are hidden and obscure, and easily concealed, such as under rugs, chair cushions, along windows and doors, under wall paper, etc.

The invention is a thin flexible contact switch tape manufactured by laminating continuous longitudinal conductive film strips separated by parallel resilient thin longitudinal fiber strips between protective insulating films. One conductive strip and its cover strip, preferably the top, have a corrugated wavy form along the central portion where joined. This provides a feel for instance, when touched by the hand, gives positive contact action and improves coiling characteristics when coiled in a roll. This wavy configuration is necessary in coiling because the parallel metallic conductors are formed to take different radii when coiled, and so one of the conductors must be able to stretch or contract longitudinally. The corrugations permit this coiling without damage.

This configuration allows momentary contact with light pressure at any position along the tape strip. The thickness of the thin flexible spacer fiber strips and the distance between said spacer fiber strips control the pressure required to make contact. This contact switch tape can be manufactured on a continuous roll and cut to any desired length. To connect a pair of wires for operating the switch, an adhesive tape is designed to fold over connecting wires which have stripped ends that are folded back and inserted in the end gap of the contact switch tape. Squeezing the connection fastens it securely.

This contact switch tape can also be manufactured with an adhesive to facilitate fastening the contact switch tape on wall surfaces, window ledges, or other places which require sensing. The applications of this thin flexible contact switch tape are numerous and because this tape can be cut to any length, it can be custom fit to any specific place. In a second embodiment, one cover strip has a raised portion to inherently provide the necessary spacing between the conductive strips. This can be satisfactory for some light duty.

OBJECTS OF THE INVENTION

Accordingly, a principal object of the invention is to provide new and improved tape switch means.

Another object of the invention is to provide new and improved tape switch means comprising a flexible laminated contact switch tape with conductive film strips held separated by thin resilient fiber spacer strips all sandwiched between protective strips.

Another object of the invention is to provide a new and improved continuous thin flat tape switch comprising: a first insulating cover strip, a second insulating cover strip, a first conductive strip bonded to the first cover strip, said strips having a formed corrugated shape where joined, first and second spacer insulating strips running parallel to each other and mounted between the first and second cover srips, a second conductive strip bonded to the second cover strip between the first and second spacer insulated strips, whereby when the tape switch is pressed, contact is made between the first and second conductive strips.

These and other objects of the invention will be apparent from the following specification and drawings of which:

BEST MODE OF THE INVENTION

Figure 1A:
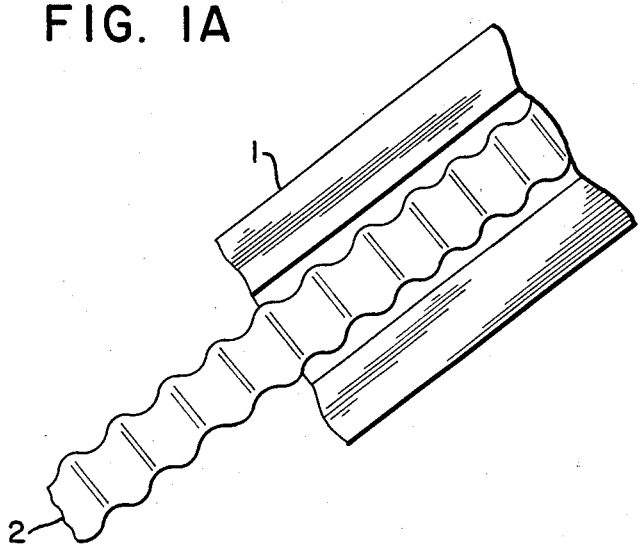
FIGS. 1A and 1B an exploded perspective view of an embodiment of the invention.
Figure 1B:
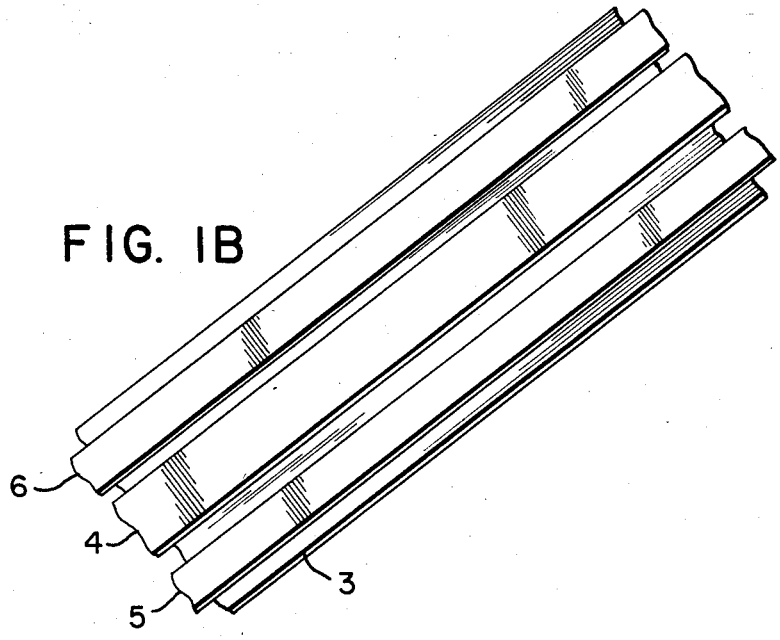

Referring to the drawings, FIG. 1 shows a tape switch having a first upper insulating cover strip 1. A conductor strip 2 is bonded to the upper cover strip 1, and this assembly is corrugated to provide a corrugated wave-like conductive strip along the mid-portion of the cover strip. The purpose of the corrugations is to provide a feel, for instance, when touching with the hand also provides a positive contact and more importantly, improved coiling characteristics when the tape switch is coiled in a roll. The bottom cover strip 3 has a flat condutive strip 4 bonded to it. Both the top and bottom cover strips, 1 and 3, may be of any insulating material such as plastic. A pair of insulating spacer strips 5 and 6 are mounted between the cover strips on either side of the lower conductive strip 4.

Figure 2:
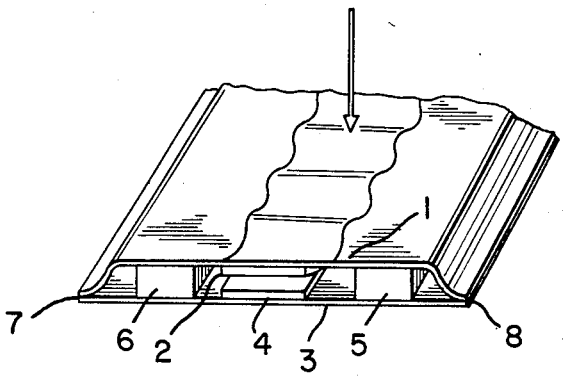
FIG. 2 is an end view of the embodiment of FIG. 1 with exaggerated thickness to show parts and design.

As illustrated in FIG. 2, when the tape switch is pressed as shown by the arrow, the conductive strips 2 and 4 will make contact. The insulating spacer strips 5 and 6 may be of a flexible insulating material such as polyester. The cover strips are sealed together along their edges 7 and 8. The cover strips may also be of polyester film. The corrugated surface of the members 1 and 2 may be provided by running the assembly of strips 1 and 2 through a heated forming machine which will selectively form and corrugate the conductor and mid-portion of cover strip. In the alternate embodiment of this invention, FIG. 3, this forming also offsets the corrugation plane to give separation between conductors without the separators 5 and 6.

Figure 3:
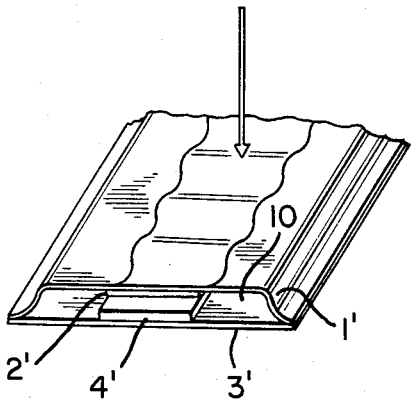
FIG. 3 is an end view of another embodiment of the invention.

FIG. 3 shows an end view of the embodiment of the invention where the upper cover strip 1' has a raised portion 10. The upper strip 2' is bonded to the upper cover strip 1' within the raised portion. The lower cover strip 3' has bonded to it a second conductive strip 4'. In this embodiment, the raised portion provides the space 10 when the switch is in the open position as shown in FIG. 3. When the switch is pressed as indicated by the arrow, contact will be made between the conductor strips 2'and 4'. The conductive strips may be made of aluminum or copper foil or other conductive material. The strips may be made very thin so that the tape switch assembly is very thin.

It is claimed:

1. Tape switch comprising:

a first insulating cover strip, a second insulating cover strip, a first conductive strip bonded to the first cover strip, said first cover strip and said first conductive strip having a corrugated wavy form, first and second spacer strips running parallel to each other and mounted between the first and second cover strips, a second conductive strip bonded to the second cover strip between the first and second insulated strips, whereby when the tape switch is pressed at any point, contact is made between the first and second conductive strips.

2. Tape switch comprising a first cover strip having a central raised portion, a first conductive strip bonded to the first cover strip within the raised portion, said strips having a corrugated wave form where they are bonded together, a second insulating cover strip and a second conductive strip bonded to the second cover strip underneath but held apart from the first conductive strip, whereby when the tape switch is pressed, contact is made between the first and second conductive strips.

* * * * *